United States Patent [19]

Stupar

[11] 3,977,104

[45] Aug. 31, 1976

[54] MULTI-PURPOSE IDENTIFICATION TAG AND CLIP

[76] Inventor: John A. Stupar, 165 W. Larkspur St., Munhall, Pa. 15120

[22] Filed: June 19, 1975

[21] Appl. No.: 588,337

[52] U.S. Cl. ..... 40/2 R; 40/316

[51] Int. Cl.[2] ..... A44C 3/00

[58] Field of Search ..... 40/316, 317, 318, 322, 40/310, 19.5, 2 R

[56] References Cited

UNITED STATES PATENTS 3,861,068 1/1975 Zygmunt ..... 40/316

D192,845 5/1962 Cohen ..... D96/3

*Primary Examiner*—Louis G. Mancene
*Assistant Examiner*—John H. Wolff
*Attorney, Agent, or Firm*—Sherman Levy

[57] ABSTRACT

A multipurpose identification tag and clip is provided that includes a member that has an identification number or letter or other marking thereon. The clip includes a recessed portion for receiving therein a member such as a wire that is to be identified. The clip is reusable and has a construction so that it can be readily placed on or removed from the part to be identified.

3 Claims, 6 Drawing Figures

MULTI-PURPOSE IDENTIFICATION TAG AND CLIP

BACKGROUND OF THE INVENTION

1. Field of the Invention

The present invention relates to identification tags and clips, and more particularly to a multi-purpose identification tag and clip that is especially useful by automotive mechanics for identifying various parts being disassembled or disconnected from an automobile or the like. However, the clips of the present invention can also be used by do-it-yourself persons and the clips can also be used for identifying other parts besides automotive accessories.

2. Summary of the Invention

Multi-purpose auto wire tags or clips are provided that are reusable and which can be easily pressed on or pulled off. The clips have permanently marked numbers and letters, and the clips are easily seen. Further, the clips or tags are adapted to be made of heat resistent material and wherein spring tension maintains the members in their proper location on the wires or other parts. The tags or clips can also be used for marking bolts or other elements.

The primary object of the present invention is to provide number clips that are made of durable plastic or the like and wherein the heads of the clips have numbers molded or otherwise formed therein. The clips are pliable and the clips serve to identify wires, cables, bolts, and the like as to their position in relation to the engine so that a mechanic or other person can return the items to their original positions.

Still another object of the present invention is to provide multi-purpose identification tags and clips that are simple and inexpensive to manufacture and which are durable in form and efficient to use.

Other objects and advantages will become apparent in the following specification when considered in the light of the attached drawings.

DESCRIPTION OF THE PREFERRED EMBODIMENT

Figure 1:
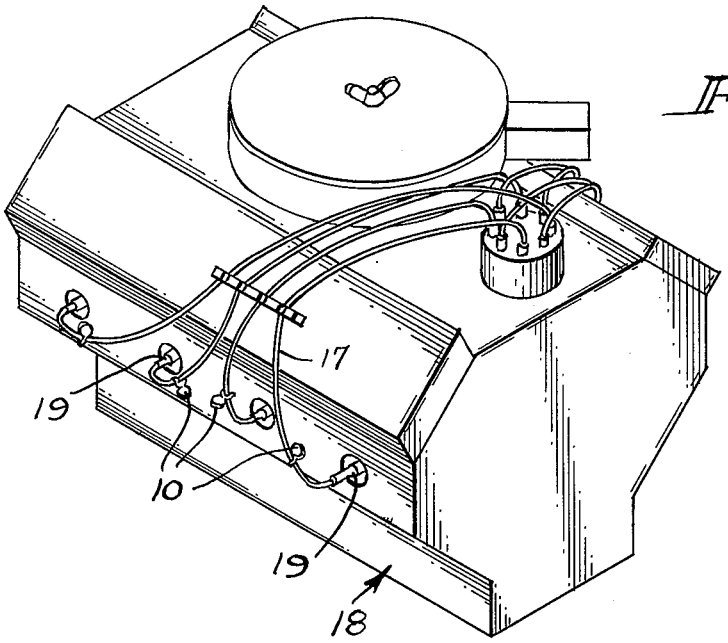
FIG. 1 is a perspective view illustrating one application of the present invention.
Figure 2:
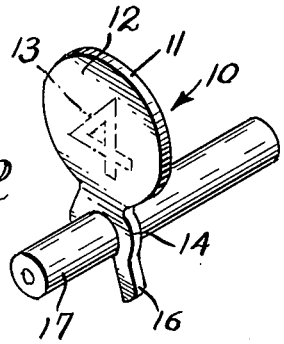
FIG. 2 is an enlarged perspective view of one of the number clips shown mounted on a wire being identified.

Referring now to the drawings in detail and more particularly to FIGS. 1–4 of the drawings wherein like reference characters indicate like parts throughout the several figures, the numeral 10 indicates one of the multi-purpose identification tags of the present invention which is shown to comprise a body member 11 that includes a support portion or head 12 that may have a circular formation, FIG. 2. The support portion 12 has a suitable identification thereon such as the numeral 4 or other indicia may be arranged on the portion 12.

Figure 3:
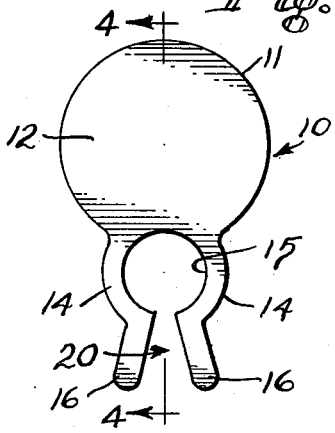
FIG. 3 is a plan view of a clip or tag.
Figure 4:
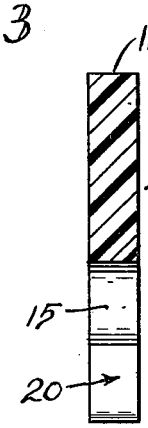
FIG. 4 is a sectional view taken on the line 4—4 of FIG. 3.

As shown in FIG. 3, the clip 10 includes a pair of spaced apart arcuate sections 14 that define there between a generally circular recess 15 for receiving a member or part such as a wire 17. A pair of angular wires angularly arranged divergent projections or prongs 16 extend from the arcuate sections 14. In FIG. 1 the numeral 18 indicates a member such as an automobile engine that may include parts such as spark plugs 19 that have wires such as the wires 17 connected thereto in the usual manner.

As shown in FIG. 3, the outer ends of the projections 16 are spaced further apart than the inner end portions of the projections 16 whereby there is defined and provided an inclined throat or guiding surface between the projections 16. This throat that is indicated by the numeral 20 communicates with the recess 15 to provide a convenient means for guiding the parts such as the wire 17 into the recess 15.

Figure 6:
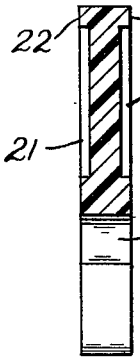
FIG. 6 is a sectional view taken on the line 6—6 of FIG. 5.
Figure 5:
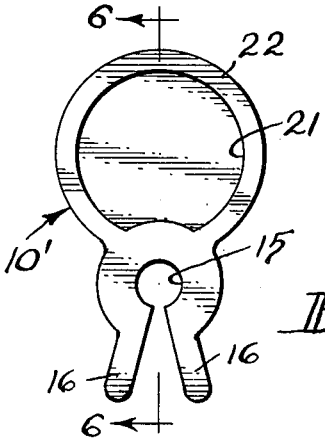
FIG. 5 is a plan view of a modified identification tag or clip.

Attention is directed to FIGS. 5 and 6 of the drawings wherein there is illustrated a slightly modified or alternative construction wherein the clip is indicated by the numeral 10'. The clip 10' includes the support portion that has recesses 21 on each side thereof. These recesses 21 define generally circular flange portions 22, and these recesses and flanges 22 help protect the indicia or markings that are arranged on the surface of the clip 10'.

From the foregoing, it will be seen that there has been provided a multi-purpose identification tag and clip. In use with the parts as shown in the drawings, when parts are being worked on such as parts of an automobile engine such as the engine 18, clips such as the clips 10 having different markings or indicia 13 thereon can be easily and conveniently mounted on parts such as the wire 17 so that when it is desired to reassemble the parts, the user will know the proper location for the wires or other parts. The clips 10 are adapted to be made of a suitable material such as plastic. Each of the clips has the recessed portion 15 that snuggly receives a member such as the wire 17 to be identified. Further, each clip includes the prong or projection 16 that is arranged angularly with respect to each other so as to provide a guiding surface therebetween for the wire 17 being positioned in the recess 15.

In the modification shown in FIGS. 5 and 6, the clip may have slightly recessed portions 21 so that the clip 10' of FIGS. 5 and 6 has the flange portion 22 that in certain instances may be to provide protection for the markings or indicia on the clip 10'. Also, as shown in FIGS. 5 and 6, the opening or recess 15 is of slightly smaller size than the recess 15 shown in the clip 10 of FIGS. 1–4. It is to be understood that the size of these parts can be varied as desired.

The parts can be made of any suitable material and in different shapes and sizes as desired or required.

Some of the advantages of the multi-purpose auto wire tags are as follows. The clips or tags are reusable, can be easily pressed on and pulled off. The tags have permanently marked numbers and letters as indicated by the numeral 13 and wherein the indicia 13 can be easily seen and the numbers or letters can stick up and the tags can be marked on both sides. The tags are made of heat resistent material so that they can be left on the wires while the car is being used. The tags are constructed so that spring tension is provided so that the tags will be kept in their proper place on the wire. The tags are light in weight. The tags can be made of plastic or can have a plastic outer coating so that shorts will be prevented if the tag touches metal or other wire. The tags can be used to mark bolts so that different sized bolts can be reinstalled in the correct places.

The tags can be used on ignition wires to take the guess work out of tuning a car. When changing spark plugs, the wires can be marked near the spark plugs in a simple sequence for an eight cylinder, six cylinder engine or the like. When changing the distributor cap, the wires can be marked near the distributor cap in a 1–8 or a 1–6 sequence clockwise or counterclockwise only noting the starting point. Also, the tags can be used on alternator wires to mark or indicate ground, field and battery wires or distinguishing any other small diameter wire. The tag can also be used on carburetor hoses and vacuum lines, transmission lines, linkage, bolts and the like.

The tag of the present invention is not restricted to use by authorized mechanics and are also especially convenient for use by do-it-yourselfers. Further, the tags can be used on many other items besides automobiles or vehicles.

The number clips or tags of the present invention are adapted to be made of durable plastic, and wherein the numbers can be molded into the heads of the clips. The clips are pliable and are attachable to various size wires or parts. Their purpose is to identify wires, cables, bolts and the like as to their position in relation to the engine. This will enable a mechanic to return the items to their original position. Further, proper wiring makes for a more efficient engine and saves the mechanic pressures and valuable time.

Additional embodiments of the invention in this specification will occur to others and, therefore, it is intended that the scope of the invention be limited only by the appended claims and not by the embodiments described hereinabove. Accordingly, reference should be made to the following claims in determining the full scope of the invention.

What is claimed is:

1. An identification apparatus for selective application to and removal from the ignition wires of an internal combustion engine comprising a planar substantially circular body having generally parallel surfaces with selected indicia thereon, a pair of pliable arcuate sections connected at one end to one edge of said body and extending outwardly therefrom, said arcuate sections defining a substantially circular clip adjacent to said body, said clip having a generally circular opening extending therethrough along an axis generally normal to the plane of said surfaces of said body, the other end of said arcuate sections being spaced from each other a distance less than the diameter of said opening, a guide prong connected to said other end of each arcuate section and extending outwardly therefrom in the plane of said parallel surfaces, said guide prongs having flat diverging guide surfaces for guiding an ignition wire into said opening, whereby an ignition wire having a diameter substantially corresponding to the diameter of said opening is guided between said prongs without causing damage and said wire spreading said arcuate sections apart so that said wire may be received within said opening.

2. The structure of claim 1 in which said parallel surfaces of said body include recessed portions defined by generally circular flange portions adjacent to the outer edge.

3. The structure of claim 1 in which said identification apparatus is made of thermoplastic material.

* * * * *